US006333754B1

(12) United States Patent
Oba et al.

(10) Patent No.: US 6,333,754 B1
(45) Date of Patent: Dec. 25, 2001

(54) IMAGE DISPLAYING MEDIUM CONTAINING AT LEAST TWO KINDS OF PARTICLES HAVING DIFFERENT COLORS AND DIFFERENT CHARACTERISTICS, METHOD FOR DISPLAYING IMAGE USING SAME AND IMAGE DISPLAYING APPARATUS INCLUDING SAME

(75) Inventors: Shota Oba; Kiyoshi Shigehiro; Yoshinori Machida; Nobuyuki Nakayama; Yoshiro Yamaguchi; Motohiko Sakamaki; Minoru Koshimizu; Takeo Kakinuma, all of Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/621,457

(22) Filed: Jul. 21, 2000

(30) Foreign Application Priority Data

May 31, 1999 (JP) ..... 12-162355
Jul. 21, 1999 (JP) ..... 11-205725

(51) Int. Cl.[7] ..... B41J 2/41

(52) U.S. Cl. ..... 347/112; 345/107; 359/296; 347/153

(58) Field of Search ..... 347/111, 112, 347/151, 153; 430/19, 32, 41; 345/84, 107; 359/290, 296; 399/158, 131

(56) References Cited

U.S. PATENT DOCUMENTS 3,689,400 * 9/1972 Ota et al. ..... 399/131
6,045,955 * 4/2000 Vincent ..... 359/296 X

FOREIGN PATENT DOCUMENTS 62-269124 * 11/1987 (JP) .
11-119704 * 4/1999 (JP) .

OTHER PUBLICATIONS

Jo et al. "New Toner Display Device (I)—Image Display Using Conductive Toner and Charge Transport Layer–", Japan Hardcopy '99 Fall Meeting Proceedings, 1999, pp. 249–252.

Jo et al., "New Toner Display Device (II)", Japan Hardcopy '99 Fall Meeting Proceedings, 1999, pp. 10–13.

Kitamura et al., "Toner Display by Electrical Movement of Conductive Toner", The Institute of Image Information and Television Engineers, Technical Report vol. 24, No. 16, 2000, pp. 7–11.

Kawai, "Development of Microcapsule –type Electrophoretic Display (MC–EPD)", Japan Hardcopy '99 Proceedings, 1999, pp. 237–240.

* cited by examiner

*Primary Examiner*—Joan Pendegrass
(74) *Attorney, Agent, or Firm*—Oliff & Berridge, PLC

(57) ABSTRACT

An image displaying apparatus, a method for displaying an image and an image displaying medium can provide an image of a large viewing angle and high stability of the particles upon repeated use. On electronic paper containing a display substrate formed of a hole transporting film, a non-display substrate formed of a film having a two-layer structure containing a charge transporting film having formed thereon an electrode layer having a thickness of about 50 $\mu$m, and conductive black particles and insulating white particles contained therebetween, an electric field is generated at a position corresponding to image data by a recording head, so as to move the black particles attached to the entire surface of the display substrate toward the non-display substrate, whereby an image of contrast of black and white is formed on the display substrate.

31 Claims, 13 Drawing Sheets

IMAGE DISPLAYING MEDIUM CONTAINING AT LEAST TWO KINDS OF PARTICLES HAVING DIFFERENT COLORS AND DIFFERENT CHARACTERISTICS, METHOD FOR DISPLAYING IMAGE USING SAME AND IMAGE DISPLAYING APPARATUS INCLUDING SAME

FIELD OF THE INVENTION

The present invention relates to a method for displaying an image, an image displaying apparatus and an image displaying medium, and more particularly, it relates to a method for displaying an image, an image displaying apparatus and an image displaying medium, by which an image can be repeatedly displayed.

BACKGROUND OF THE INVENTION

As an electronic paper technology, those utilizing various techniques have been known, such as rotation of particles, electrophoresis, thermal rewritable, liquid crystal and electrochromy. As an example of the electronic paper technologies, a display technique using a toner shown in FIG. 14 has been known, in which an electrode 82 and a charge transporting layer 84 are accumulated on each of facing surfaces of two glass substrates 80*a* and 80*b* facing each other, and an conductive colored toner 90 and white particles 92 are filled between the two substrates 80*a* and 80*b*.

The electronic paper has such a constitution that a voltage corresponding to image data is applied to the electrode 82 to form an electric field on a part of the electrode 82, so as to inject electric charge to the conductive colored toner 90 through the charge transporting layer of the non-display substrate 80*b*, whereby the conductive colored toner having electronic charge injected thereto is moved toward the display substrate 80*a* and attached thereto, so as to display an image by forming contrast of the colors of the conductive colored toner and the white particles.

However, in the electronic paper having the foregoing constitution, the process for forming the electrode and the charge transporting layer accumulated on the glass substrate is complicated and requires difficult skills, and therefore it causes a problem in that when the area of the substrate is increased, it becomes more difficult to produce products having constant performance.

Furthermore, the image displayed itself is unclear due to low contrast, and has a problem in that the viewing angle is small. Because the stability of the particles retained between the substrates is gradually deteriorated upon repeated use, it causes a problem of short service life as electronic paper.

SUMMARY OF THE INVENTION

In view of the foregoing circumstances, the invention has been made to provide a method for displaying an image, an image displaying apparatus and an image displaying medium that can provide an image of a high contrast and a large viewing angle. The invention has been also made to provide a method for displaying an image, an image displaying apparatus and an image displaying medium that can provide high stability of the particles upon repeated use.

The invention relates to, as a first aspect, a method for displaying an image containing a step of moving a display medium containing two display substrates, at least of which contains a charge transporting material, having therebetween at least one cell having at least two kinds of particles having different colors and different characteristics filled therein, relative to a head for applying an electric field that is provided on a side of one substrate of the two display substrates, so as to form an electric field on a region corresponding to image data in the display medium, whereby at least one kind of particles of the at least two kinds of particles are moved to a side of at least one of the substrates, so as to display an image.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
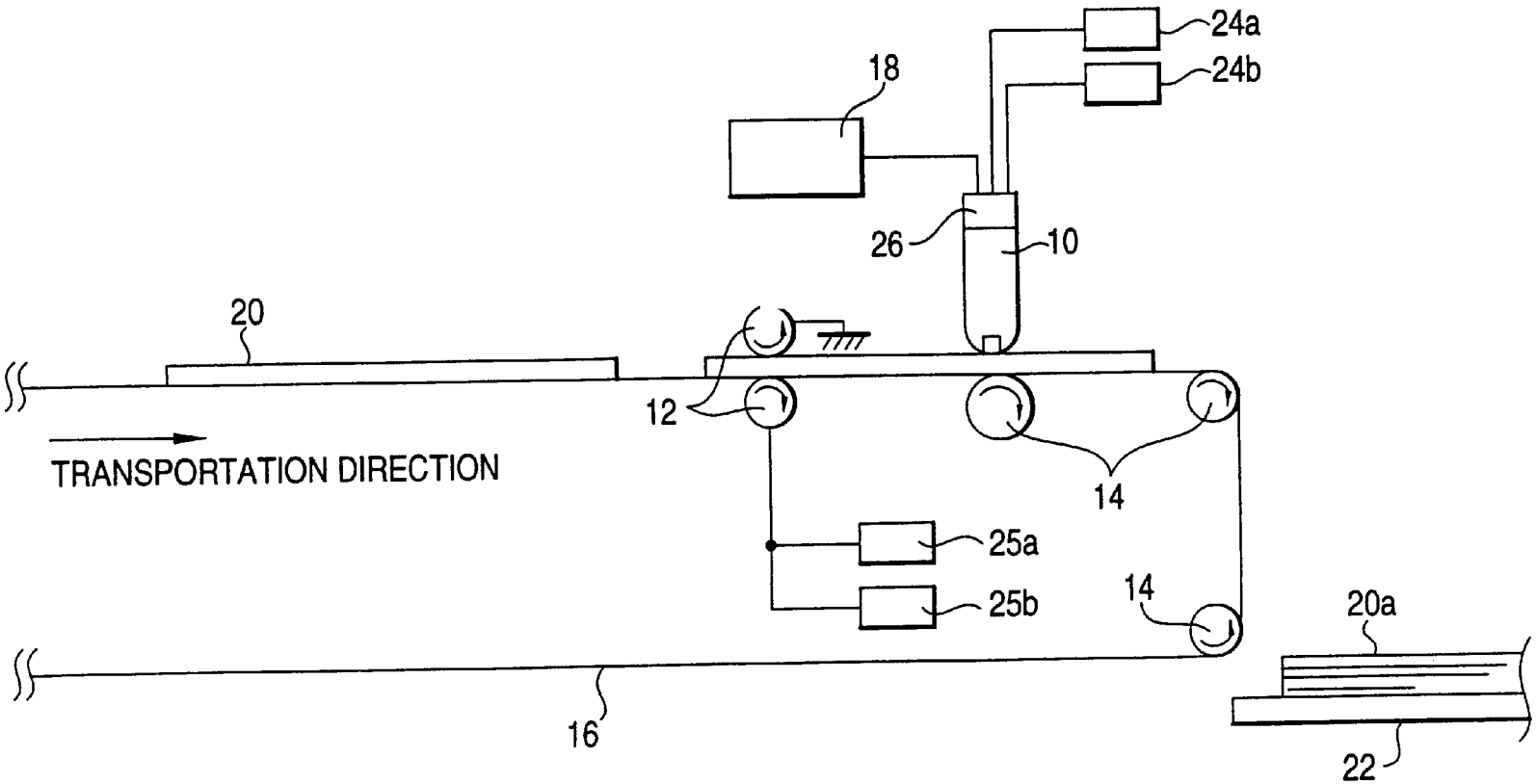
FIG. 1 is a diagram showing an image forming apparatus of the first embodiment of the invention.

Because the first aspect of the invention has a constitution in that an image is displayed on the displaying medium by using a head for applying an electric field, the display substrate can be formed with a substrate having a one-layer structure made with a charge transporting material. Therefore, there is no unevenness in display performance of the display substrate, and the production of the display substrate is easy, whereby a display substrate that always exhibits stable performance can be obtained.

Furthermore, the number of steps for the production is small and the yield of production is high, and thus there is an advantage that the production cost can be decreased in comparison to the conventional one. Because the image is displayed by the attachment of the particles, there is an advantage that the image is easy to view owing to its large viewing angle.

It is preferred to use a charge transporting polymer as the charge transporting material because the structure that withstands an external force applied to the display substrate, such as bending and elongation, can be obtained.

The invention also relates to, as a second aspect, an image displaying apparatus for realizing the method for displaying an image of the first aspect of the invention, and it contains a head for applying an electric field in the display medium, and voltage controlling means for controlling the head for applying an electric field to form an electric field corresponding to image data in the display medium, so as to move at least one kind of particles of the at least two kinds of particles in the display medium to a side of one of the substrates. By using the constitution, an image displaying apparatus that can always exhibit stable display performance can be obtained.

In the image displaying apparatus, an image can be displayed on the following image displaying media, i.e., an image displaying medium containing a first charge transporting layer, a second charge transporting layer, first particles filled in at least one cell provided in a space provided between the first charge transporting layer and a second charge transporting layer, and second particles having a different color from the first particles and being movable by an electric field, the displaying medium itself having no electrode, but the second particles being moved by application of an electric field from an outside of the image displaying medium, so as to display an image; an image displaying medium containing a first charge transporting layer, a second charge transporting layer, first particles filled in at least one cell provided in a space provided between the first charge transporting layer and a second charge transporting layer, and second particles having a different color from the first particles and being filled in the space, at least a surface of the second particles having a charge transporting property; and an image displaying medium containing a first charge transporting layer, a second charge transporting layer, first particles filled in at least one cell provided in a space provided between the first charge transporting layer and a second charge transporting layer, at least a surface of the first particles having a charge transporting property, and second particles having a different color from the first particles and being filled in the space, at least a surface of the second particles having a hole transporting property.

As the display substrate, for example, a film produced by forming an insulating resin binder having a charge transporting monomer dispersed therein, and a film produced by forming a charge transporting polymer can be used. It is more preferred that the film produced by forming a charge transporting polymer is used because the production step of the display substrate can be simplified, and deviation in charge transporting property due to dispersion unevenness on dispersing the charge transporting monomer can be avoided, so as to provide a substrate having a uniform charge transporting property throughout the entire surface of the substrate.

An anisotropic conductive layer may be formed on the substrate having a charge transporting property. In this case, the charge to be transported is not diffused, and thus the thickness of the substrate can be large.

It is preferred that the image displaying apparatus further contains relative moving means for moving the displaying medium relative to the head for applying an electric field because a large image can be formed with a head for applying an electric field having a small size that does not cover the entire surface of an image displaying surface and thus reducing the size of the apparatus.

In general, particles used for displaying an image are charged by friction of the conductive particles, and it is preferred in the invention that at least one kind of particles of the two kinds of particles are conductive particles. Conductive particles exhibit a stable charging state since they receive charge injection, and an image can be stably formed for a long period of time without causing charging unevenness and deterioration in charge amount of the particles.

It is preferred that at least one kind of particles of the at least two kinds of particles have a charging polarity opposite to that of other particles. When one kind of particles are moved to the side of one substrate by an electric field formed by the head for applying an electric field, the other kind of particles are moved to the other substrate and attached thereto, and therefore the two kinds of particles are attached to the display substrate to provide a clear image having higher contrast.

It is preferred for maintaining the gap between the display substrate and the non-display substrate at a constant distance that a maintaining member for maintaining the gap is present in the interior. Thus, the cell may be formed with a sheet member having a large number of openings, whereby the gap between the substrates can be easily maintained at a constant distance. As the sheet member, a member having a mesh form may be employed. Because a mesh member is easily available and of a low cost, and has a relatively uniform thickness, the image displaying medium can be produced at a low cost.

It is possible to use a flat sheet member, in which a large number of holes are opened by etching or laser working. In the case where the holes are formed by working, there is a freedom in shape of the holes, and thus it is effective to produce an image displaying medium for displaying fine images and for improving contrast.

It is possible that the cell is formed by working at least one of the substrate by printing or laser working. When the cell is formed by working the substrate, the shape of the cell can be freely determined, and the height of the cell can be determined by the coating pressure and the extent of working. Therefore, it becomes possible to obtain a high-definition image displaying medium.

As the cell member, an insulating member or an insulating coating of a charge transporting layer can be used. By the measure, it becomes possible to form a uniform charge to obtain a uniform image.

It is possible that the displaying medium further contains between the display substrates plural units containing plural cells having particles of colors different from each other attached to one of the substrates, whereby multi-color display is realized.

As the head for applying an electric field, for example, one having such a constitution can be used that plural electrodes are arranged as at least one line on a substrate. In the head for applying an electric field having plural electrodes arranged as one line on a substrate, the resolution can be increased by decreasing the size of the electrodes and the distance among the electrodes. More preferably, the plural electrodes are arranged as plural lines that are arranged as staggered each other in the slow scanning direction, whereby the resolution can be increased by a relatively simple production process without decreasing the distance of the electrodes.

In the case where the displaying medium is moved relative to the head for applying an electric field to display a two-dimensional image on the image displaying medium, a clear image can be obtained by moving the electrode of the head for applying an electric field under such conditions that the electrode is in contact with the displaying medium.

Therefore, when the shape of the electrode formed on the head for applying an electric field is, for example, a substantially hemisphere shape, the electrode is difficult to get stacked on the displaying medium to avoid possibility of injuring the displaying medium due to stacking up of the electrode on the displaying medium. The substantially hemisphere shape used herein includes all convex shapes having no edge on the surface thereof, such as a hemisphere shape and a semiellipse shape.

In the case where the substrate, on which the electrodes are provided, of the head for applying an electric filed is formed with an elastic material, even when the surface of the displaying medium has large irregularity, the substrate deforms corresponding to the irregularity, and thus an image corresponding to image data can be always displayed on the display medium.

When a high voltage is applied in a moment to the bias applied on switching, electric discharge may be formed. When the wiring of the electrode is formed with a resistive material, the formation of electric discharge can be prevented, and thus possibility of breakage of the displaying medium due to electric discharge caused on switching can be eliminated. The resistive material is preferably an insulating material having transparent conductive particles dispersed therein.

For example, a material containing glass having transparent conductive particles, such as $RuO_2$ series powder conductive glass material, dispersed therein can be used. In this case, another advantage that the production can be easily conducted can be obtained because it can be produced by printing, as wiring, a glass paste having the $RuO_2$ series powder conductive glass material dispersed therein by screen printing, followed by baking.

It is preferred that the voltage controlling means applies to the head for applying an electric field a direct current voltage or a voltage formed by superposition of an alternating current voltage and a direct current voltage.

When the bias applied to the head for applying an electric field is a direct current voltage or a voltage formed by superposition of an alternating current voltage and a direct current voltage, an image having high contrast and high fineness can be obtained.

Furthermore, it is preferred that the image displaying apparatus further contains, before the head for applying an electric field, a refreshing electrode forming an electric field, by which the particles moving to the side of the substrate by the electric field applied by the head for applying an electric field are attached to the other substrate.

When the particles are arranged on the side of the other substrate before applying the electric field to the display medium by the head for applying an electric filed, the particles are moved to the display substrate only by the action of the electric field formed by the head for applying an electric field, and thus an image of high image quality that precisely reflects image data can be obtained. In the case where the refreshing electrode is formed with an elastic material, even when large irregularity is formed on the surface of the displaying medium, the refreshing electrode deforms corresponding to the irregularity, so as surely arrange the particles on the side of the other substrate. It is preferred that when the refreshing electrode is in the form of a pair of rollers nipping the display medium, the nip area can be large, and thus the particles are sufficiently arranged even when the processing speed becomes high.

The invention also relates to, as a third aspect, a method for displaying an image containing a step of applying, to a displaying medium containing at least one cell containing pixel electrodes divided into plural pixels and a flat electrode having filled therebetween at least two kinds of particles having different colors containing particles having a charge transporting property at least on a surface thereof, a voltage on a pixel electrode at a position corresponding to image data, so as to form an electric field in a region of the displaying medium corresponding to image data, whereby at least one kind of particles of the at least two kinds of particles are attached to the pixel electrodes, so as to display an image.

In the third aspect of the invention, because a charge transporting layer is formed on at least one kind of particles of the at least two kinds of particles filled in the cell inside the displaying medium, it is not necessary to form a charge transporting layer on the first displaying substrate or the second displaying substrate, and thus the displaying medium can be formed only with the pixel electrode or the flat electrode.

Thus, the display performance of the displaying substrate exhibits no unevenness, and a displaying substrate always having stable performance can be obtained since the production of the displaying substrate is simple. Furthermore, because the number of steps in the production process is small and the yield of production is high, there is advantage in that the production cost can be reduced in comparison to the conventional one. Moreover, because the image is displayed by the attachment of the particles, there is advantage in that a clear image having a wide viewing angle can be obtained.

The invention further relates to, as a fourth aspect, an image displaying apparatus for realizing the method for displaying an image of the third aspect of the invention and for displaying an image, for example, on the image displaying media described for the image displaying apparatus of the second aspect. The image displaying apparatus contains a voltage controlling means for applying a voltage to form an electric field corresponding to image data on the pixel electrodes, so as to attach at least one kind of particles of the at least two kinds of particles on a position of the pixel electrodes corresponding to image data on the pixel electrodes. By using the constitution, an image displaying apparatus that always has stable display performance can be obtained.

When the particles having a surface of a charge transporting property are conductive particles having on a surface thereof a charge transporting layer containing a charge transporting material, the time required for injecting the charge can be advantageously shortened.

When at least one kind of particles of the at least two kinds of particles are particles having on a surface thereof a charge transporting layer of a hole transporting property, and the other kind of particles are particles having on a surface thereof a charge transporting layer of an electron transporting property, the following advantages can be obtained. Because the attaching force to the displaying substrate upon applying the electric field is high, and when at least one kind of particles of the at least two kinds of particles are moved to one substrate, the other kind of particles are moved to the side of the other substrate and attached thereto, the two kinds of particles are attached to the display substrate to stably form a clear image of higher contrast for a long period of time.

When the particles having a surface of charge transporting property are particles containing a charge transporting material, the production thereof becomes easy since the step of coating a charge transporting material on core particles can be omitted.

When one kind of particles are particles formed with a charge transporting material of a hole transporting property, and the other kind of particles are particles formed with a charge transporting material of an electron transporting property, the two kinds of particles are attached to the display substrate, so as to stably form a clear image having higher contrast for a long period of time.

In the image displaying apparatus having such a constitution, since the size of the pixel is determined by the size of the electrode, it is necessary, for increasing the resolution, to form the electrodes with a small size and a small distance between the pixels. Because the respective electrodes are connected to wiring, the smaller the electrodes are formed and the smaller the distance between the pixels is set, problems are caused in the arrangement of the wiring.

Thus, when wiring for applying a voltage connected to the plural electrodes are formed on a transparent insulating layer formed by accumulating on a surface of the pixel electrodes, the distance between the pixels can be reduced by forming the wiring on the layer above the pixel electrodes, and thus the resolution can be increased until the minimum electrode size that can be technically formed.

(First Embodiment)

An image displaying apparatus of the first embodiment of the invention contains, as shown in FIG. 1, a recording head 10 for forming an electric field at a position of electronic paper 20 corresponding to image data, refreshing electrodes 12 for forming an electric field uniformly on the electronic paper 20, a transporting belt 16 for carrying to transport the electronic paper 20 supplied from an electronic paper supplying part not shown in the figure, transporting rollers 14 for moving the transporting belt 16, a controlling part 18 for applying a voltage to the recording head 10 corresponding to image data and controlling an applied voltage to apply to the electronic paper 20 an electric field corresponding to the image data, and a carrier 22 carrying the electronic paper 20 having an image displayed thereon.

Figure 2A:
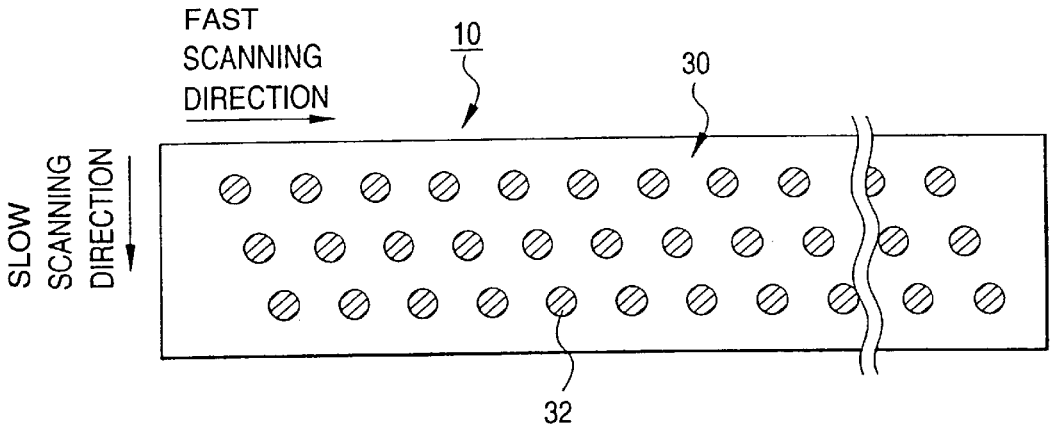
FIG. 2A is a top plan view showing the arrangement of an electrode on a recording surface of the recording head shown in FIG. 1.
Figure 2B:
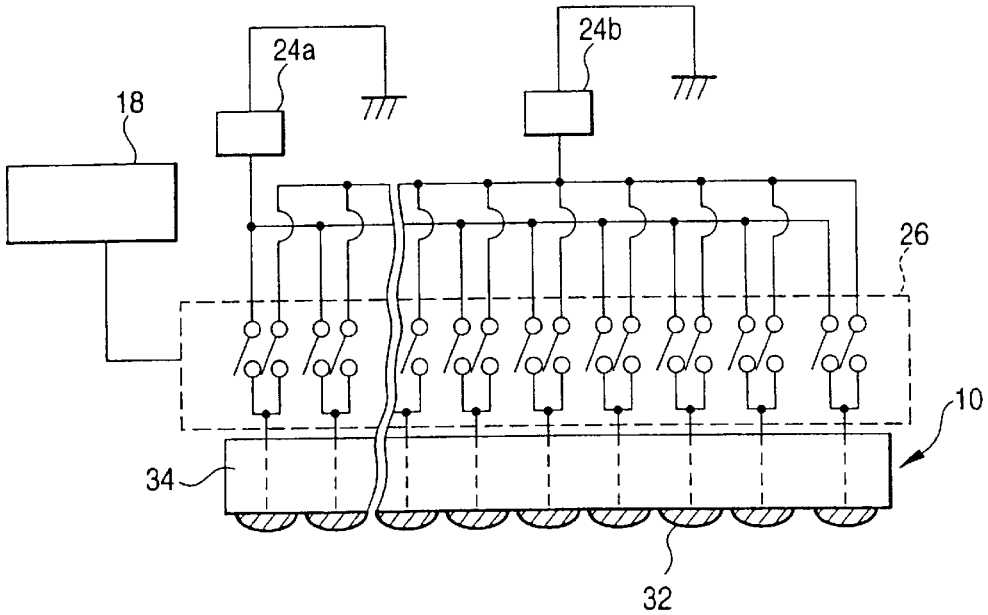
FIG. 2B is a schematic diagram showing an electric power source connected to the recording head.

The recording head 10 contains, as shown in FIG. 2A and FIG. 2B, for example, a substrate 34 made with a material having elasticity, such as rubber, and plural substantially hemisphere electrodes 32 having a semiellipse shape and a diameter, for example, of 100 $\mu$m, which are protruded toward the outside.

Figure 3:
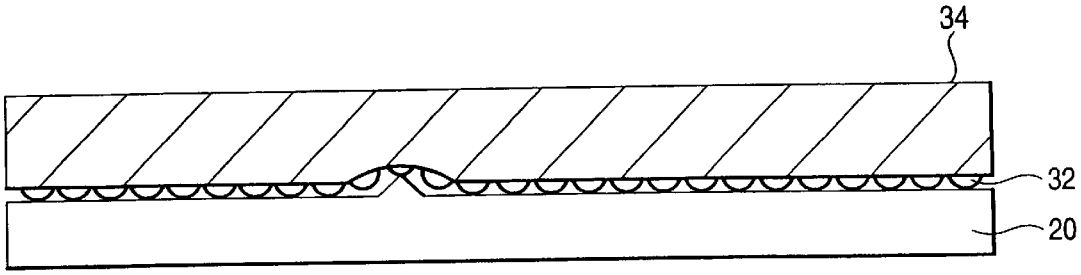
FIG. 3 is a diagram showing the state of a recording head that is deformed along the convex part of electronic paper.

Because the substrate 34 has elasticity, even when irregularity is present on the electronic paper 20, it deforms corresponding to the irregularity as shown in FIG. 3. Therefore, the conditions of contacting to the electronic paper 20 always becomes good, and an electric field precisely reflecting the image data can be applied to the electronic paper 20.

The plural electrodes 32 are arranged on one surface to be a recording surface 30 of the substrate 34 in a matrix form. That is, plural, for example three, electrode arrays, each of which contains electrodes arranged in one line with an interval in the width direction (i.e., the fast scanning direction) of the electronic paper 20, are arranged in a matrix form, so that the electrodes do not overlap in the slow scanning direction.

As shown in FIG. 2B, respective electrodes 32 are connected to an AC electric power source 24*a* and a DC electric power source 24*b* through a connection controlling part 26, to which a voltage formed by superposition of an AC bias and a DC voltage is applied.

The connection controlling part 26 contains plural pairs of switches, each of which contains a switch connected to the electrode 32 at one end and to the AC electric power source 24*a* at the other end, and a switch connected to the electrode 32 at one end and to the DC electric power source 24*b* at the other end.

The pair of switches are controlled to on and off by a controlling part 18, and the AC electric power source 24*a* and the DC electric power source 24*b* are electrically connected to the electrode in such a manner that the voltage is applied only to the electrodes 32 at the position corresponding to the image date based on the instruction from the controlling part 18.

The refreshing electrodes 12 contain a pair of elastic rollers formed with an elastic material. The elastic rollers are formed, for example, with two conductive rubber rollers, which are formed by adding carbon black to rubber into a cylindrical shape of 20 cm, and an AC electric power source 25*a* and a DC electric power source 25*b* are connected thereto to apply a voltage formed by superposition of an AC bias and a DC voltage.

The refreshing electrode 12 rotate as sandwiching the electronic paper 20 carried on the transporting belt 16 along with the transporting belt 16, and apply a uniform electric field to the electronic paper in the direction opposite to the direction of the electric field that is applied by the recording head 10 to the electronic paper 20 corresponding to the image data.

Figure 4:
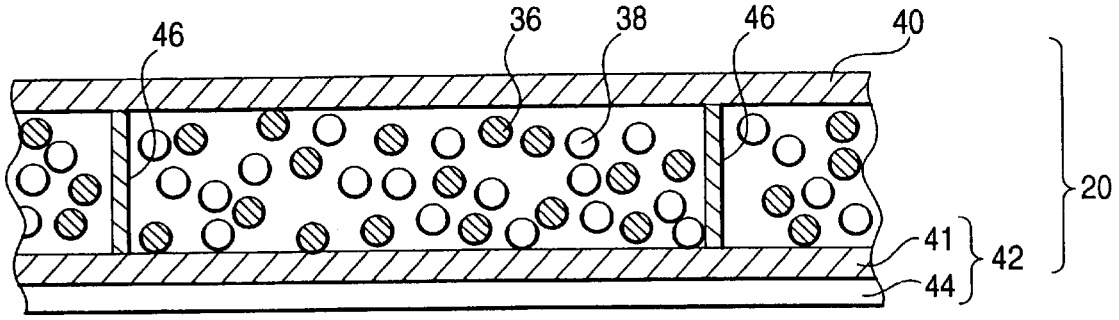
FIG. 4 is a schematic diagram showing the structure of electronic paper.

The electronic paper 20 contains, as shown in FIG. 4, a display substrate 40 and a non-display substrate 42 having particles 36 and 38 of two colors filled therebetween. The display substrate 40 is formed with a hole transporting film, and examples of the hole transporting film include those produced by the following methods. For one example, N-methylcarbazole diphenylhydrazone as a hole transporting substance is added to a polyethylene resin in an amount of about 40% by weight and uniformly dispersed therein, and it is formed into a film having a thickness of about 50 $\mu$m. For another example, β,β-bis(methoxyphenyl) vinyldiphenylhydrazone as a hole transporting substance is added to a polyethylene resin in an amount of about 40% by weight and uniformly dispersed therein, and it is formed as a charge transporting material into a film having a thickness of about 50 $\mu$m.

The non-display substrate 42 is constituted by a film having a two-layer structure containing a charge transporting film 41 having formed thereon an electrode layer 44 having a thickness of about 50 $\mu$m. The charge transporting film used in the non-display substrate 42 may be a hole transporting film transporting a hole as similar to the display substrate 40, or in alternative, an electron transporting film transporting an electron and a film transporting a hole and an electron.

Between the display substrate 40 and the non-display substrate 42, spacers 46 are provided with an interval, for example, of about 100 μm, whereby the distance between the display substrate 40 and the non-display substrate 42 is maintained at a constant distance, and a cell is formed between the spacers 46. The spacers can be formed on one of the display substrate 40 and the non-display substrate 42, for example, by screen printing.

Figure 15A:
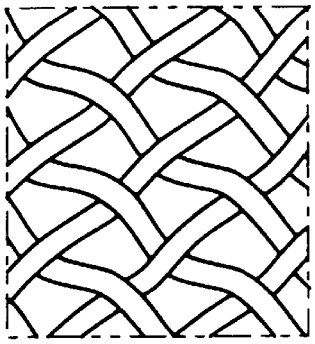
PRIOR ART FIG. 15A
FIGS. 15A and 15B are diagrams showing examples of a spacer.
Figure 15B:
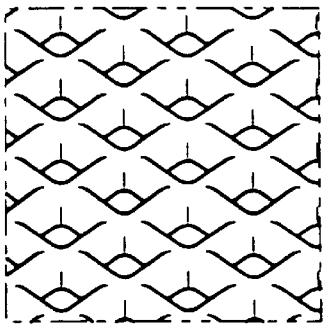

A mesh sheet shown in FIGS. 15A and 15B may be sandwiched by the substrates as a spacer, and a sheet obtained by opening holes by etching or laser working in a mesh sheet of 70 mesh having a wire diameter of 70 μm and an opening ratio of 65%.

One kind of particles 36 of the particles 36 and 38 of two colors filled in the cell between the display substrate 40 and the non-display substrate 42 are conductive particles, and for example, black conductive particles having a true spherical shape formed with amorphous carbon having an average particle diameter of 20 μm and a resistivity of $10^{-2}$ Ω·cm can be used. The black conductive particles having a true spherical shape formed with amorphous carbon are formed through carbonization by baking a thermosetting phenol resin.

The conductive particles used herein means those capable of transferring charge by contact with the substrate. Examples of the material having such a function include carbon black, particles of a metal, such as nickel, silver, gold and tin, and particles having coated with or containing these materials.

Specifically, examples thereof include conductive particles having a true spherical form containing fine particles made with a crosslinked copolymer containing divinylbenzene as a main component having nickel electroless plating on the surface thereof (Micropearl NI, a trade name, produced by Sekisui Chemical Co., Ltd.), and conductive particles having a true spherical form obtained by farther subjecting to displacement plating with gold (Micropearl AU, a trade name, produced by Sekisui Chemical Co., Ltd.).

Furthermore, examples also include conductive particles having a true spherical form of amorphous carbon obtained through carbonization by baking a thermosetting phenol resin (Univeks GCP, H-Type, a trade name, produced by Unitika Ltd., volume resistivity: $\leqq 10^{-2}$ Ω·cm), conductive particles having a true spherical form further coated with a metal, such as gold and silver (Univeks GCP Conductive Particles, a trade name, produced by Unitika Ltd., volume resistivity: $\leqq 10^{-4}$ Ω·cm), conductive particles having a true spherical form containing oxide fine particles having a true spherical form of silica or alumina having Ag and tin oxide coated on the surface thereof (Admafine, a trade name, produced by Admatechs Co., Ltd.), and particles containing mother particles of various materials, such as a styrene resin, an acrylic resin, a phenol resin, a silicone resin and glass, having conductive fine particles attached on the surface thereof or buried therein.

The other kinds of particles 38 of the two kinds of particles of two colors are insulating white particles functioning as hiding particles, and examples thereof include particles having a true spherical form made with a crosslinked copolymer containing divinylbenzene as a main component having a particle diameter of about 20 μm.

In the first embodiment, the same amounts of the two kinds of particles 36 and 38 are mixed and filled between the display substrate and the non-display substrate at a filling rate of about 50%. It is possible that the amount of the black particles is larger than the amount of the white particles, and the mixing ratio may be appropriately adjusted.

The case will be described, in which an image is formed on the electronic paper having the constitution described in the foregoing, by the image displaying apparatus having the constitution described in the foregoing.

Figure 5A:
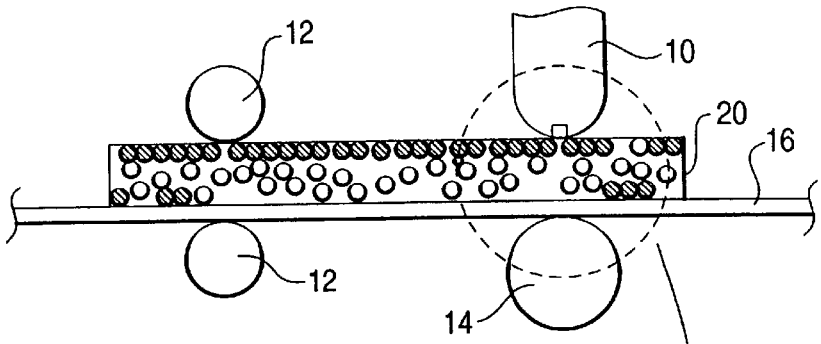
FIGS. 5A and 5B are diagrams showing the movement of particles in electronic paper caused by an electric field formed with a recording head in the electronic paper.
Figure 5B:
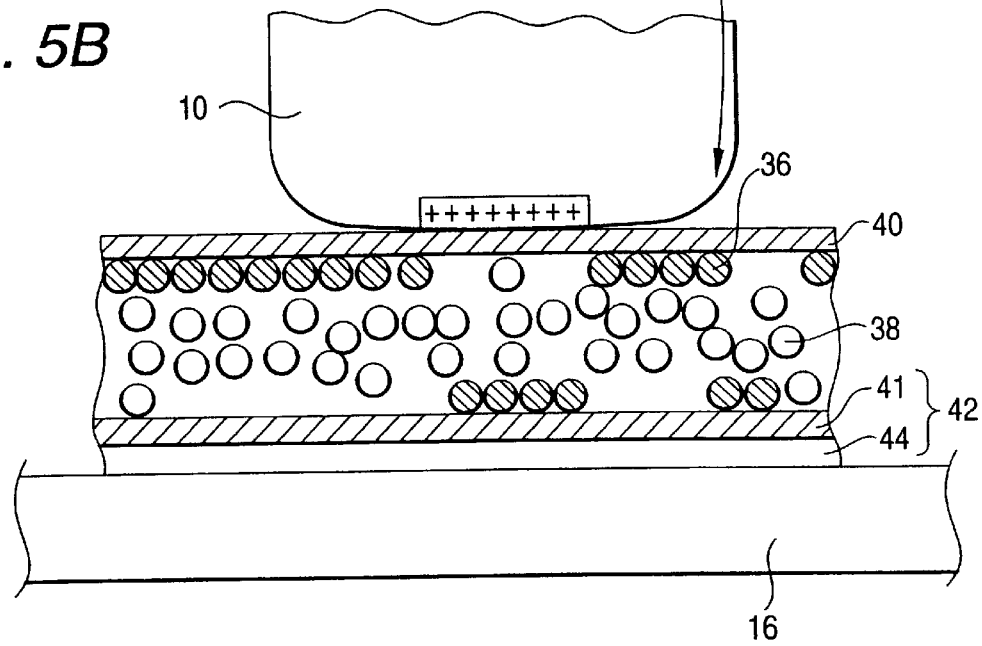

As shown in FIG. 1, in the image displaying apparatus of the first embodiment, the transporting belt 16 is successively driven at a speed of about 100 mm/sec by the transporting rollers 14, and the electronic paper 20 supplied from the electronic paper supplying part not shown in the figure is placed on the transfer belt by one ply by one ply and transported toward the refreshing electrode 12 of the later step. FIG. 5A is an enlarged diagram showing a part where the refreshing electrode 12 and the recording head 10 are arranged, and FIG. 5B is a further enlarged diagram showing a part where the recording head 10 is arranged.

The refreshing electrode 12 applies an electric field on the entire surface of the electronic paper 20 transported by the transporting belt 16. Thus, the display substrate 40 is charged negatively, and positive charge is injected from the non-display substrate 42, whereby all the black particles 36 contained in the electronic paper 20 are charged positively and attracted by the display substrate 40, as shown in FIG. 5A, and thus the entire surface of the display substrate 40 of the electronic paper 20 becomes black.

After the refreshing electrode 12, the recording head 10 is provided, and thus the recording head 10 applies an electric field to the position corresponding to the image data on the electronic paper 20 having passed through the refreshing electrode 12. The region of the display substrate 40 applied with the electric field by the recording head 10 is charged positively as shown in FIG. 5B, and thus the positively charged black particles 36 attracted thereto are moved to the non-display substrate 42. Therefore, the region of the display substrate 40, on which the black particles 36 are not attached, becomes white, and an image formed by contrast of black and white is produced on the electronic paper 20.

The position corresponding to the image data herein is a position where a pixel is not formed since the black particles 36 are removed from the display substrate 40 to make the position white for forming an image. On the other hand, it is possible that positive charge is applied by the refreshing electrode to make the state where the black particles 36 are removed from the display substrate 40, and then negative charge is applied from the recording head 10 to attach the black particles 36 to the display substrate 40. In this case, the position corresponding to the image date is a position where a pixel is formed.

Figure 16:
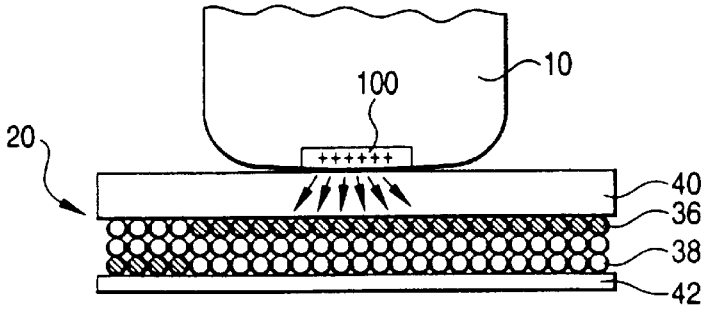
FIG. 16 is a diagram showing an anisotropic conductive layer.

An anisotropic conductive layer may be formed on one surface of the electronic paper 20. Because the electronic paper 20 is handled as a sheet, it necessarily has certain rigidity. While the rigidity can be ensured by increasing the thickness of the substrate, when the thickness of the substrate is increased, as shown in FIG. 16, positive charge 100 is scattered in the planar directions upon passing through the substrate, and it becomes difficult to display an image of high resolution. In the anisotropic conductive layer, on the other hand, flow of the charge is restricted to one direction, and thus the charge is not scattered even when the thickness of the substrate becomes large, so as to provide an image of high resolution. Therefore, when an anisotropic conductive layer having an appropriate thickness is provided on at least one of the facing substrates of the image displaying medium, the rigidity of the image displaying medium can be ensured without causing deterioration of the resolution.

Figure 17:
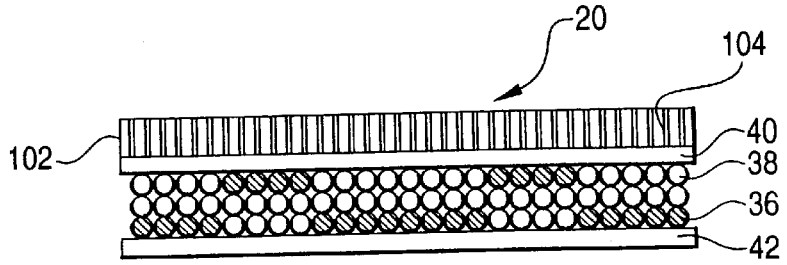
FIG. 17 is another diagram showing an anisotropic conductive layer.
Figure 18:
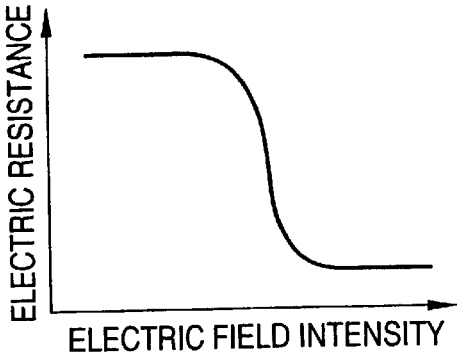
FIG. 18 is a graph showing the relationship between the electric field intensity and the electric resistance of an anisotropic conductive layer.

Examples of the anisotropic conductive layer include, as shown in FIG. 17, an insulating base material 102 having conductive pin members 104 having a diameter, for example, of from 10 to 100 μm that are independently buried in the thickness direction of the insulating base material 102.

Furthermore, it is also possible to use an insulating base material containing conductive stick filler having a diameter of from 0.1 to 10 $\mu$m that are arranged in the direction perpendicular to the plane of the insulating base material by an action of magnetism. In these materials, the charge flows in the thickness direction through the charge transporting layer of the anisotropic conductive layer, and therefore the scattering of the charge upon moving can be prevented even when the thickness of the anisotropic conductive layer becomes large.

Figure 19:
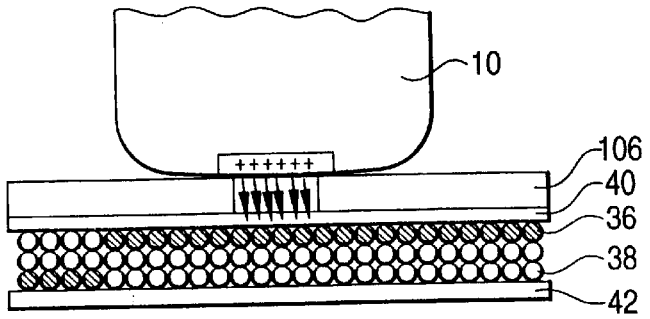
FIG. 19 is another diagram showing an anisotropic conductive layer.

Furthermore, a semiconductive base material, the resistivity of which is changed by the electric field intensity, can also be used as the anisotropic conductive layer. The semiconductive base material exhibits a high resistivity under a low electric field, but the resistance is remarkably decreased under a high electric field. For example, it is possible to use one having an electric resistivity of $10^{14}$ Ω·cm or more under the conditions where no electric field is applied, and having an electric resistivity of $10^4$ Ω·cm or less under the conditions where an electric field of from $10^5$ to $10^7$ V/m is applied. Examples of the semiconductive material include a material based on polyvinyl chloride, polyethylene, polyimide or Teflon, in which conductive fine particles are dispersed to adjust the resistance. By using the materials, as shown in FIG. 19, the electric resistance of the anisotropic conductive layer 106 can be changed corresponding to the electric field pattern for forming an electrostatic latent image, and thus the electric resistance can be decreased only for the necessary part, so as to flow the charge only in the thickness direction.

The electronic paper 20 having the image formed thereon is placed on the carrier 22 provided after the recording head 10. Plural sheets of the electronic paper 20 are stacked on the carrier 22 one by one.

The resulting image is of high fineness and good contrast, and when the image is repeatedly formed on the same electronic paper 20 about 1,000 times, the images formed on the electronic paper 20 in all the cycles involve no problem, such as disorder of the image and image formation failure of tile electronic paper 20. Thus, it is understood that the electronic paper 20 used in the first embodiment of the invention has a long service life and high image displaying performance.

In the first embodiment, as an example of the charge transporting film used for the display substrate 40 and the non-display substrate 42, the hole transporting film produced by dispersing N-methylcarbazole diphenylhydrazone in a polyethylene resin, so as to impart the hole transporting property, and the hole transporting film produced by dispersing β,β-bis(methoxyphenyl)vinyldiphenylhydrazone in a polyethylene resin, so as to impart the hole transporting property. Further examples of the other charge transporting films include a hole transporting film formed with a resin having a hydrazone compound, a stilbene compound, a pyrazoline compound or an arylamine compound dispersed therein, an electron transporting film formed with a resin having a fluorenone compound, a diphenoquinone compound, a pyran compound or zinc oxide dispersed therein, and a charge transporting resin having a self-supporting property. It is more preferred to use a charge transporting resin having a self-supporting property since a structure that withstands an outer force applied to the image displaying medium, such as bending and elongation, can be produced.

The charge transporting resin having a self-supporting property includes a charge transporting polymer. Examples thereof include polyvinyl carbazole, polycarbonate produced by polymerization of the specific dihydroxyarylamine and bischloroformate described in U.S. Pat. No. 4,806,443, polycarbonate produced by polymerization of the specific dihydroxyarylamine and phosgene described in U.S. Pat. No. 4,806,444, polycarbonate produced by polymerization of bishydroxyalkylarylamine and bischloroformate or phosgene described in U.S. Pat. No. 4,801,517, polycarbonate produced by polymerization of the specific dihydroxyarylamine or bishydroxyalkylarylamine and bischloroformate, or polyester produced by polymerization of bisacylhalide described in U.S. Pat. Nos. 4,937,165 and 4,959,288, polycarbonate or polyester of arylamine having the specific fluorene skeleton described in U.S. Pat. No. 5,034,296, polyurethane described in U.S. Pat. No. 4,983,482, polyester having the specific bisstylylbisarylamine as a main chain described in JP-A-59-28903, a polymer having a charge transporting substituent, such as hydrazone and triarylamine, as a pendant group described in JP-A-61-20953, JP-A-1-134456, JP-A-1-134457, JP-A-1-134462, JP-A-4-133065 and JP-A-4-133066, and a polymer having a tetraarylbenzidine skeleton reported in "The Sixth International Congress on Advanced in Non-impact Printing Technologies, 306 (1990)".

Furthermore, the charge transporting polymers represented by the general formula (I-1) or (I-2) described in JP-A-8-253568 can be used. In the formulae, Y represents a divalent hydrocarbon group, Z represents a divalent hydrocarbon group, A represents a group represented by formula (I-3) (wherein R1 and R2 each independently represents a hydrogen atom, an alkyl group, an alkoxy group, a substituted amino group or a halogen atom, X represents a substituted or unsubstituted divalent aromatic group, n represents an integer of from 1 to 5, and k represents 0 or 1), B and B' each independently represents a group —O—(Y—O)$_m$—H or a group —O—(Y—O)$_m$—CO—Z—CO—OR' (wherein R' represents a hydrogen atom, an alkyl group, a substituted or unsubstituted aryl group or a substituted or unsubstituted aralkyl group, Y represents a divalent hydrocarbon group, Z represents a divalent hydrocarbon group, and m represents an integer of from 1 to 5), m represents an integer of from 1 to 5, and p represents an integer of from 5 to 5,000. Furthermore, a charge transporting polymer of the general formula (I-1) or (I-2) wherein X represents the structural formula (II) or (III) can also be used.

(I-1)

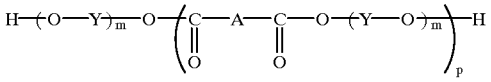

-continued (I-2)

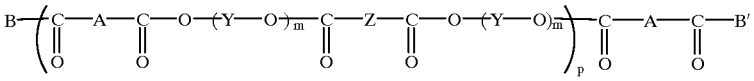

(I-3)

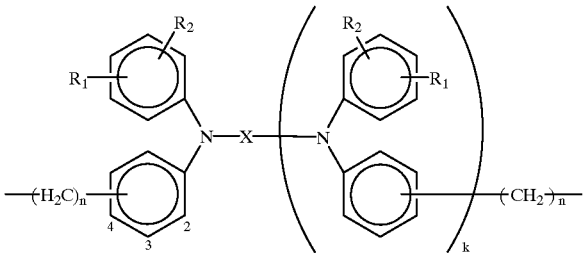

(II)

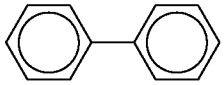

(III)

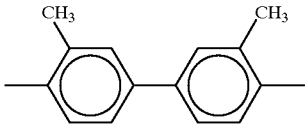

Figure 6:
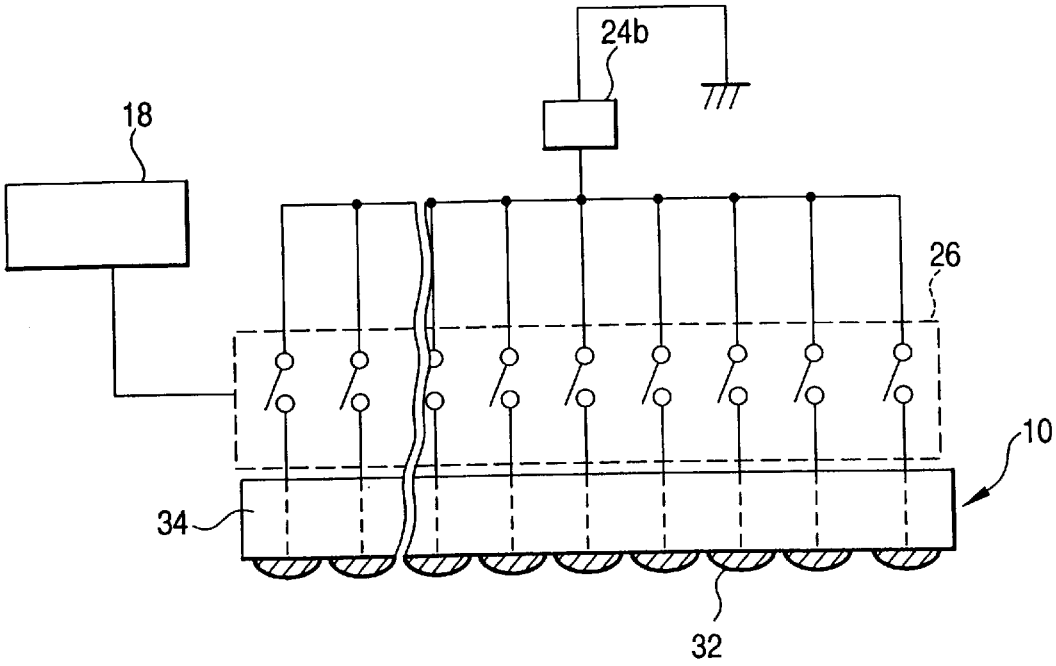
FIG. 6 is a schematic diagram showing another electric power source connected to the recording head.

While a voltage formed by superposition of an AC bias and a DC voltage is applied of the respective electrodes 32 of the recording head 10 in the first embodiment, it is possible that only the DC electric power source 24*b* is connected to apply only a DC voltage as shown in FIG. 6.

Figure 7:
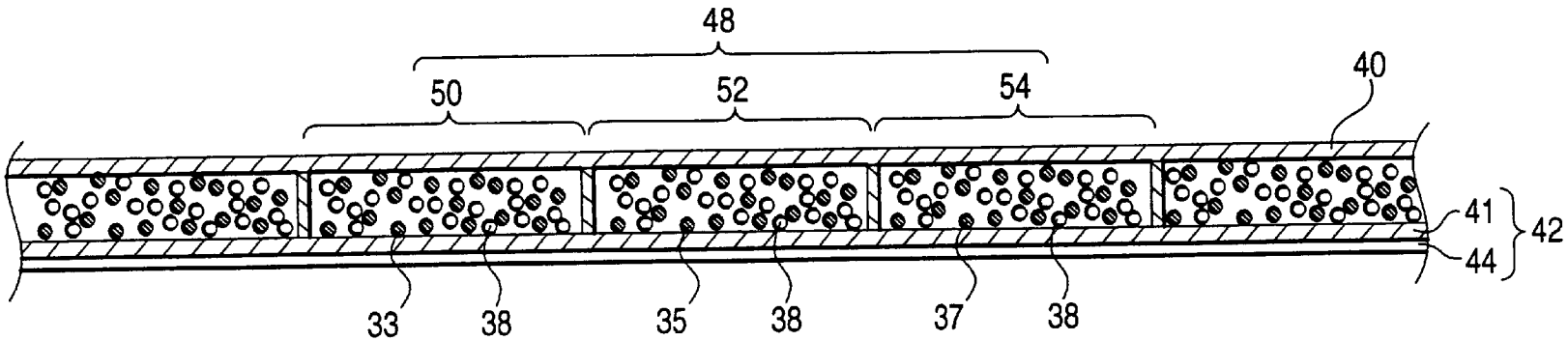
FIG. 7 is a schematic diagram showing electronic paper displaying a color image.

A color image can be displayed by using electronic paper having the constitution shown in FIG. 7, in which a large number of units 48 are formed therein, each of which contains a first cell 50 containing conductive particles 30 colored yellow (Y) instead of the black conductive particles 36, a second cell 52 containing conductive particles 35 colored magenta (M) instead of the black conductive particles 36, and a third cell 54 containing conductive particles 37 colored cyan (C) instead of the black conductive particles 36.

As a modified example of the first embodiment, the constitution, from which the refreshing electrode 12 is omitted, can be employed because an image can be formed on the electronic paper even when the refreshing electrode 12 is not used. By using a metallic roller as the transporting roller 14 provided as facing the recording head 10, the metallic roller can also function as an electrode, and therefore the metallic roller can be used instead of the refreshing electrode 12.

(Second Embodiment)

An image displaying apparatus according to the second embodiment is a modified example of the image displaying apparatus of the first embodiment, and contains, inside a housing 28 of a box form, a recording head 10, a refreshing electrode 12, a driving roller 15*a*, a driven roller 15*b*, electronic paper 21 and a controlling part 18.

An opening part 28*a* is formed on the side wall of the housing 28, and the opening part 28*a* is an image displaying part displaying the electronic paper 21. The electronic paper 21 inside the housing 28 is formed as an endless belt, which can be produced, for example, by adhering ends of electronic paper having a width of 220 mm and a length of 650 mm.

The electronic paper 21 used in the second embodiment has the same structure as in the first embodiment, and detailed description thereof will be omitted, provided that the electronic paper used in the second embodiment is different from that in the first embodiment in the point where the mixing ratio of the particles 36 and 38 of two colors filled between the display substrate 40 and the non-display substrate 42 is (black particles 36)/(white particles 38)=2/1 in this embodiment.

The endless electric paper 21 is rotated by the driving roller 15*a* and the driven roller 15*b* and is controlled in such a manner that different parts thereof are exposed from the opening part. The driving roller 15*a* is driven by a driving motor M, and the driving motor M is driven under the control of the controlling part 18.

The controlling part 18 controls the rotation rate of the driving roller 15*a* driven by the driving motor M to such a rate that the moving rate of the electronic paper under recording of an image of one image plane by the recording head 10 becomes a rate suitable for recording.

For example, in the case where the recording by the recording head 10 is continuously conducted (i.e., the image displaying apparatus is set to display images one by one), the driving roller 15*a* is controlled to have a constant rotation rate. In the case where the image displaying apparatus is set to display an image immediately after recording by the recording head 10, the driving roller 15*a* is controlled in such a manner that the rotation rate thereof is increased after the completion of the recording of one image plane by the recording head 10, and after the recorded image is displayed in the image displaying part, the rotation is stopped not to move the image displayed in the image displaying part.

The other constitutions including the mechanisms of displaying an image on the electronic paper 21 are the same as in the first embodiment, and the descriptions thereof are omitted.

When the image displaying apparatus is used, and an image is displayed at a moving rate of the electronic paper 21, for example, of 100 mm/sec, the resulting image is of good contrast and high fineness.

When images are repeatedly formed on the same electronic paper 20 about 1,000 times, elongation or slack of the electronic paper 20 is not formed, and the images formed on the electronic paper 20 in all the cycles involve no problem, such as disorder of the image and image formation failure. Thus, it is understood that the image displaying apparatus of the second embodiment has a long service life of displaying an image and high image displaying performance.

Figure 8A:
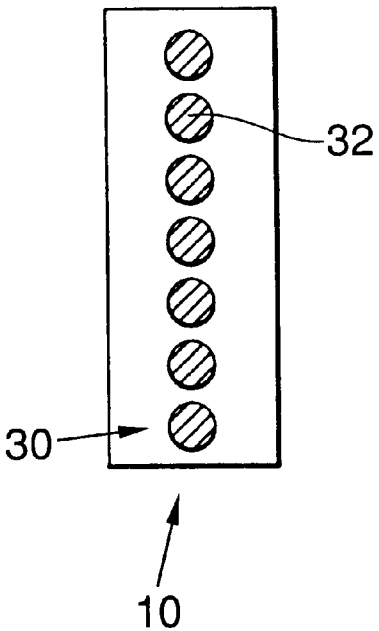
FIGS. 8A to 8D dare top plan views showing examples of another arrangement of an electrode on a recording surface of the recording head.
Figure 8B:
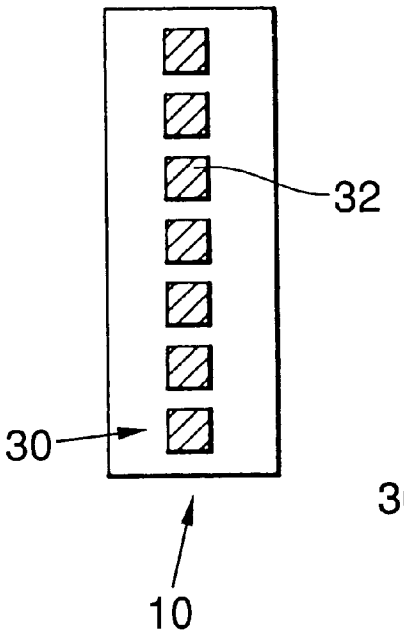
Figure 8C:
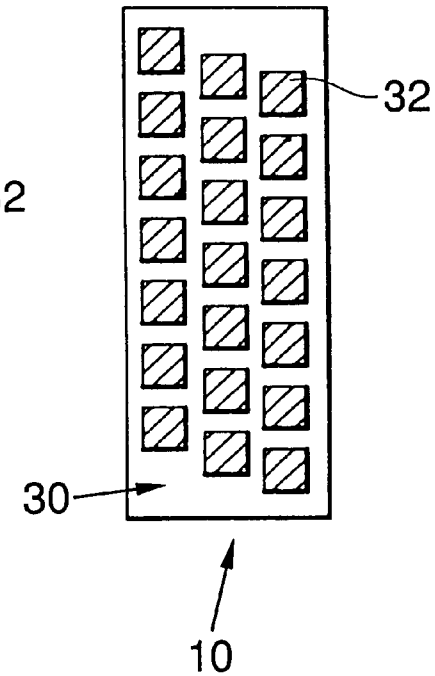
Figure 8D:
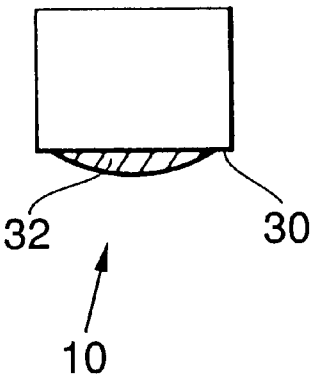
Figure 9:
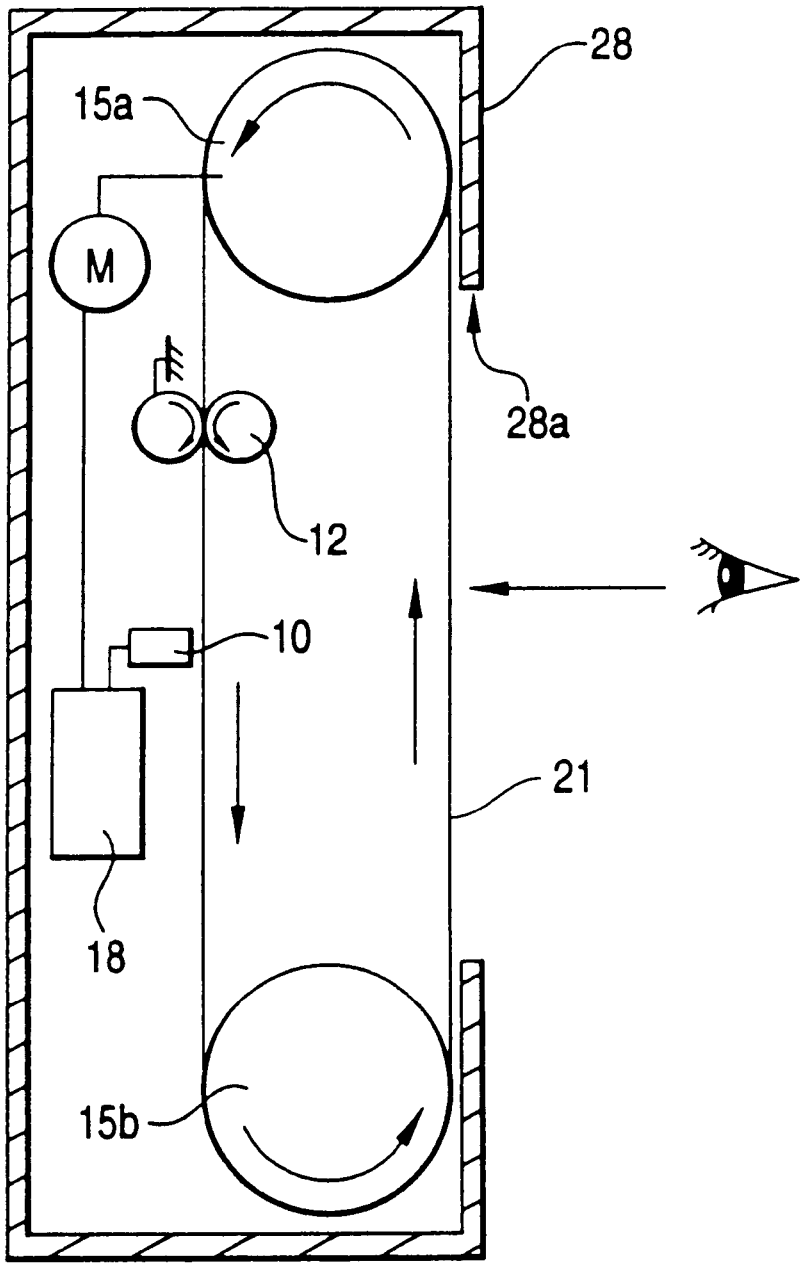
FIG. 9 is a schematic diagram showing an image forming apparatus of the second embodiment of the invention.

In the first embodiment and the second embodiment, the arrangement of the electrodes 32 on the recording surface 30 of the recording head 10 is not limited to the arrangement shown in FIG. 2A, and may be one line as shown in FIG. 8A and FIG. 8B. The shape of the electrodes is not limited to the hemispherical shape having a semiellipse cross section, and may be a rectangular shape having a semiellipse cross section as shown in FIGS. 8B to 8D.

(Third Embodiment)

Figure 10:
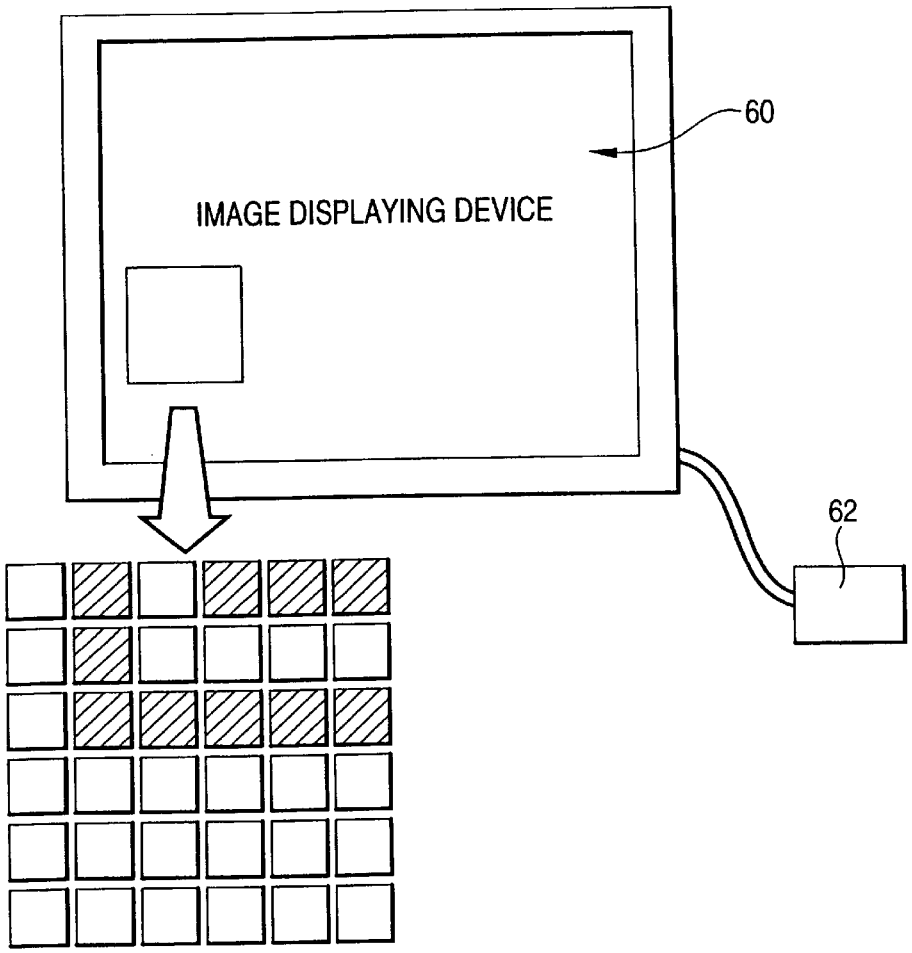
FIG. 10 is a schematic diagram showing an image forming apparatus of the third embodiment of the invention.

An image displaying apparatus according to the third embodiment of the invention contains, as shown in FIG. 10, a display part 60 for displaying an image and a controller 62 for displaying an image in the display part 60 based on image data.

Figure 11:
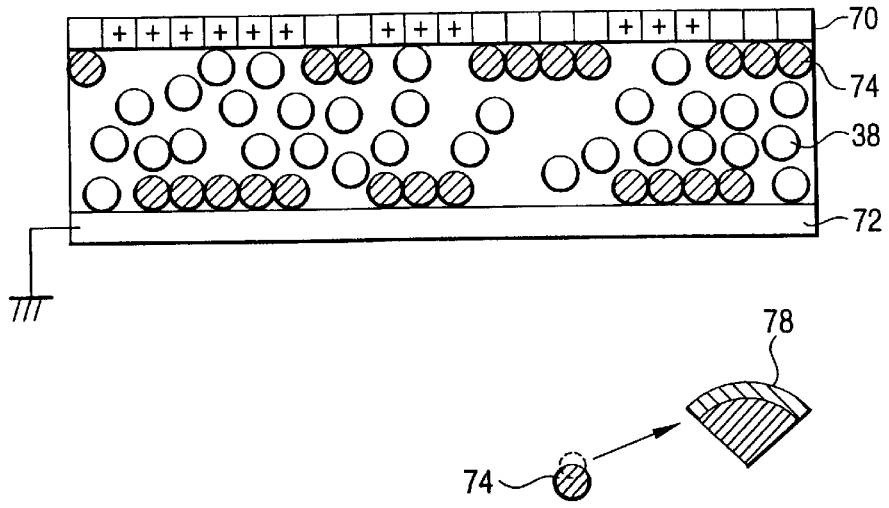
FIG. 11 is a schematic diagram showing a display part of the image forming apparatus shown in FIG. 9.

The display part 60 has such a constitution, as shown in FIG. 11, that particles 74 and 38 of two colors are filled between a display substrate 70 and a non-display substrate 72.

Figure 12:
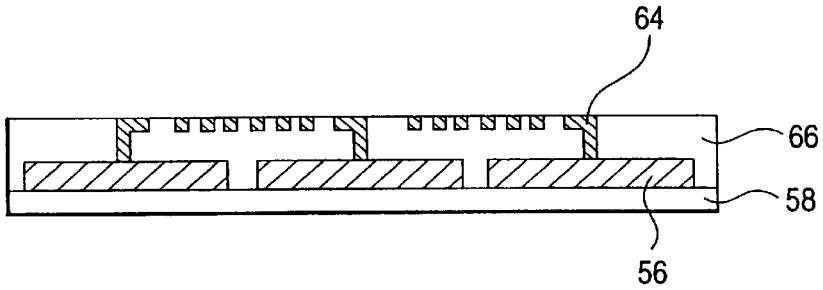
FIG. 12 is a schematic diagram showing the electrode part shown in FIG. 11.

The display substrate 70 has such a constitution, as shown in FIG. 12, that plural ITO pixel electrodes 56 are provided on a glass substrate 58, and one having a structure where ITO pixel electrodes having a size of 100 $\mu$m×100 $\mu$m are arranged with an interval of about 10 $\mu$m can be used. The non-display substrate 72 has such a constitution that an ITO electrode is formed on the entire surface of a glass substrate, and the ITO electrode is grounded.

A spacer not shown in the figure is formed between the display substrate 70 and the non-display substrate 72, whereby the distance between the display substrate 70 and the non-display substrate 72 is maintained at a constant distance, and cells are formed.

One kind of the particles 74 of the particles 74 and 38 of two colors filled between the display substrate 70 and the non-display substrate 72 are conductive colored particles having a hole transporting layer 78 formed on the surface thereof. The third embodiment employs, as the one kind of particles 74, it is possible to use particles containing black conductive particles having a true spherical form made with amorphous carbon having an average particle diameter of about 10 $\mu$m and a resistivity of about $10^{-2}$ Ω·cm having polycarbonate, to which about 40% by weight of N-methylcarbazole phenylhydrazone as a hole transporting substance is added and uniformly dispersed, coated to a thickness of about 3 $\mu$m as a hole transporting layer 78.

As the charge transporting material for forming the conductive particles and the hole transporting layer, those described in the first embodiment can be employed, and thus the detailed descriptions thereof are omitted.

The other kind of particles 38 of the particles of two colors are insulating white particles functioning as hiding particles, and the similar ones as in the first embodiment can be used.

In the third embodiment, the two kinds of particles 74 and 38 are mixed at a ratio (black particles 74/white particles 38)=1/2, and filled between the display substrate 70 and the non-display substrate at a filling ratio of about 50%. The mixing rate can be appropriately adjusted.

Respective pixel electrodes 56 of the display substrate 70 are connected to the controller 62 through wiring 64. The controller 62 forms distribution of an electric field corresponding to the image data on the display part 60 by applying a voltage to a pixel at a position corresponding to the image data.

That is, because the pixel electrode 56 applied with a voltage takes positive charge as shown in FIG. 11, positive charge is injected into the black particles 74 through that part. Accordingly, the black particles 74 is removed from the pixel electrode 56, to which the voltage is applied, and the black particles 74 are attached only to the pixel electrode 56, to which the voltage is not applied. Therefore, the region of the display substrate 70 where the black particles 74 are not attached becomes white, and thus an image of contrast of black and white is formed.

The position corresponding to the image data herein is the position where a pixel is not formed because the image is formed by making the position white by removing the black particles 74 from the display substrate 70. When a voltage is applied to make the pixel electrode 56 taking negative charge, the black particles 74 are attached to the pixel electrode 56, to which the voltage is applied, and thus the position corresponding to the image data is a position where a pixel is formed.

In the third embodiment, because the wiring 64 for connecting the pixel electrodes are buried in a transparent insulating layer 66 provided as an upper layer of the pixel electrode to make buried wiring, the distance between the electrode is short, and a precision image can be displayed. The wiring 64 is formed with a resistive material having a transparent conductive material, such as Pyrox (a trade name, produced by DuPont Inc.), Inpyrox (a trade name, produced by DuPont Inc.) and LS Series (a trade name, produced by Tanaka Kikinzoku International K.K.), dispersed therein, and thus a problem such as a short circuit caused by electric discharge formed on switching can be prevented.

The image displayed in the image displaying apparatus has good contrast and high fineness, and even when images are repeatedly displayed at a rewriting interval, for example, of 20 Hz, there is no problem, such as disorder of the image and image formation failure. Thus, it is understood that the image displaying apparatus of the third embodiment has a long service life of displaying an image and high image displaying performance.

As the other kind of particles 38 of the particles of two colors, it is possible to use particles containing conductive particles having a true spherical form made with amorphous carbon having an average particle diameter of about 10 $\mu$m and a resistivity of about $10^{-2}$ Ω·cm having white-colored polycarbonate, to which about 40% by weight of a fluorenone compound as an electron transporting substance is added and uniformly dispersed, coated to a thickness of about 3 $\mu$m as an electron transporting layer 79.

Figure 13:
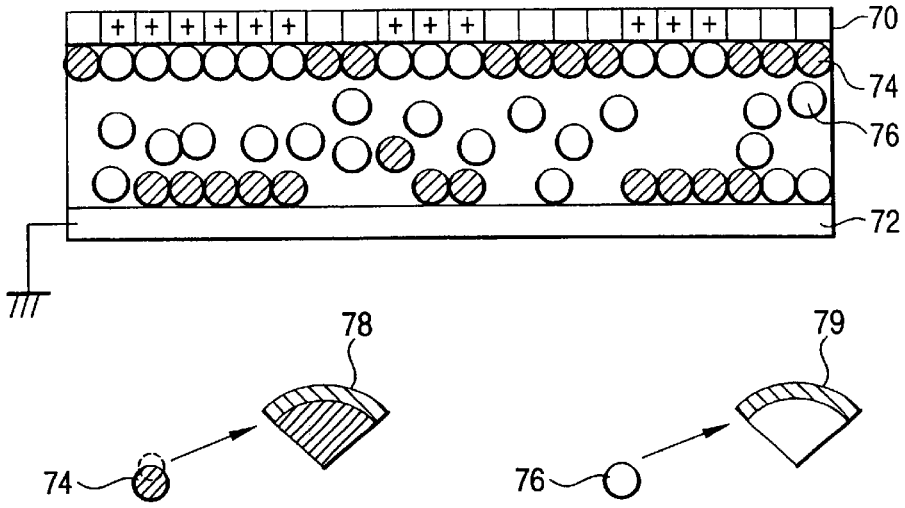
FIG. 13 is a schematic diagram showing another constitution of a display part of the image forming apparatus shown in FIG. 9.
Figure 14:
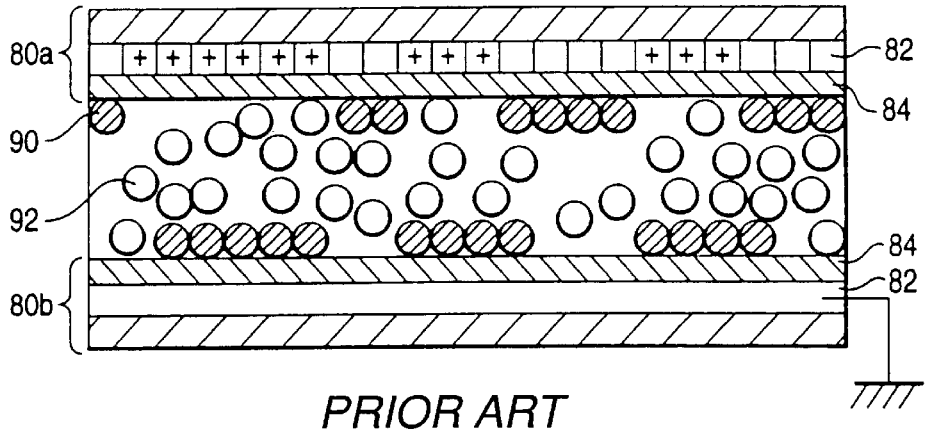
FIG. 14 is a schematic diagram showing conventional electronic paper.

In this case, as shown in FIG. 13, since the white particles 76 are attached to the region, to which the black particles 74 are not attached, an easily viewable image having higher contrast can be obtained for a long period of time.

As similar to the case shown in FIG. 7, a color image can be displayed by using, as the display part 60, such a constitution that a large number of units are formed therein, each of which contains a first cell containing conductive particles 33 colored yellow (Y), a second cell containing conductive particles 35 colored magenta (M), and a third cell containing conductive particles 37 colored cyan (C).

In the first embodiment, the second embodiment and the third embodiment, the cases, in which the black particles and the white particles are filled, are exemplified for explanatory use, but the colors are not limited to white and black, and two kinds of particles having different colors can be employed.

The particles having a different color include particles having a chromatic color, such as cyan, magenta, yellow, red, green and blue, and particles having an achromatic color, such as white and black. Examples of the white or black particles include particles having a true spherical form made with a crosslinked copolymer containing divinylbenzene as a main component (Micropearl Sp, a trade name, produced by Sekisui chemical Co., Ltd., Micropearl BB, a trade name, produced by Sekisui Chemical Co., Ltd.), fine particles of crosslinked polymethyl methacrylate (MBX-20 Black, a trade name, produced by Sekisui Chemical Co., Ltd., MBX-20 White, a trade name, produced by Sekisui Chemical Co.), fine particles of polytetrafluoroethylene (Lubron L produced by Daikin Industries, Ltd. and SST-2 produced by Shamrock Technologies Inc.), and fine particles of a silicone resin (Tospearl produced by Toshiba Silicones Co., Ltd.).

In the first embodiment, the second embodiment and the third embodiment, the cases using electronic paper that can be substituted for paper and the like as a displaying medium are exemplified for explanatory use, but the displaying medium of the invention is not limited to the electronic paper but can be applied to general rewritable displaying media including a billboard and a display.

As described in the foregoing, the invention provides an effect of providing an image having high contrast and a large viewing angle. Furthermore, it provides another effect of providing an image exhibiting good stability of the particles upon repeated use.

What is claimed is:

1. A method for displaying an image, comprising the steps of:

moving a displaying medium, comprising two display substrates formed of a charge transporting material and at least one cell formed between the substrates, relative to a head for applying an electric field provided on a side of one of the substrates, the cell containing at least two kinds of particles having different colors and different characteristics, wherein one kind of particles of the at least two kinds of particles are conductive particles;

generating an electric field in a region corresponding to image data in the displaying medium; and causing one kind of particles of the at least two kinds of particles to move towards one of the substrates by the electric field to display an image.

2. A method for displaying an image as claimed in claim 1, wherein at least one kind of particles of the at least two kinds of particles have a charging polarity opposite to the other kind of particles.

3. A method for displaying an image, comprising the steps of:

moving a displaying medium, comprising two display substrates formed of a charge transporting material and at least one cell formed between the substrates, relative to a head for applying an electric field provided on a side of one of the substrates, the cell containing at least two kinds of particles having different colors and different characteristics, wherein the displaying medium comprises plural units between the substrates, each of the units comprising a first cell containing particles of a first color and particles of a second color and a second cell containing particles of the first color and particles of a third color;

generating an electric field in a region corresponding to image data in the displaying medium; and causing one kind of particles of the at least two kinds of particles to move towards one of the substrates by the electric field to display an image.

4. An image displaying apparatus for displaying an image on an image displaying medium, comprising:

the displaying medium comprising two display substrates formed of a charge transporting material and at least one cell formed between the substrates, the cell containing at least two kinds of particles having different colors and different charging characteristics, one kind of particles of the at least two kinds of particles are conductive particles;

a head for applying an electric field in the displaying medium; and voltage controlling means for controlling the head for applying an electric field to generate an electric field corresponding to image data in the displaying medium to cause one kind of particles of the at least two kinds of particles in the displaying medium to move towards one of the substrates.

5. An image displaying apparatus as claimed in claim 4, further comprising:

relative moving means for moving the displaying medium relative to the head for applying an electric field.

6. An image displaying apparatus as claimed in claim 4, wherein the voltage controlling means applies to the head for applying an electric field a direct current voltage or a voltage generated by superimposing an alternating current voltage on a direct current voltage.

7. An image displaying apparatus as claimed in claim 4, further comprising:

in front of the head for applying an electric field, a refreshing electrode for generating an electric field that causes the particles to attach to one of the substrates, the particles otherwise moving towards the other substrate by the electric field applied by the head.

8. An image displaying apparatus as claimed in claim 4, further comprising:

relative moving means for moving the displaying medium relative to the head for applying an electric field, wherein the voltage controlling means applies to the head for applying an electric field a direct current voltage or a voltage generated by superimposing an alternating current voltage on a direct current voltage.

9. An image displaying apparatus as claimed in claim 4, further comprising:

relative moving means for moving the displaying medium relative to the head for applying an electric field; and in front of the head for applying an electric field, a refreshing electrode for generating an electric field that causes the particles to attach to one of the substrates, the particles otherwise moving towards the other substrate by the electric field applied by the head.

10. An image displaying apparatus as claimed in claim 4, further comprising:

in front of the head for applying an electric field, a refreshing electrode for generating an electric field that causes the particles to attach to one of the substrates, the particles otherwise moving towards the other substrate by the electric field applied by the head, wherein the voltage controlling means applies to the head for applying an electric field a direct current voltage or a voltage generated by superimposing an alternating current voltage on a direct current voltage.

11. A method for displaying an image comprising the steps of:

applying, to a displaying medium comprising plural pixel electrodes, a flat electrode and at least one cell therebetween containing at least two kinds of particles of different colors, one kind of particles of the at least two kinds of particles are conductive particles and some of the particles having a charge transporting property on at least the surface thereof, a voltage on the pixel electrode at a position corresponding to image data;

generating an electric field in a region of the displaying medium corresponding to the image data; and causing one kind of particles of the at least two kinds of particles to attach to the pixel electrode by the electric field to display an image.

12. A method for displaying, comprising the steps of:

applying, to a displaying medium comprising plural pixel electrodes, a flat electrode and at least one cell therebetween containing at least two kinds of particles of different colors, some of the particles having a charge transporting property on at least the surface thereof and being conductive particles comprising on the surface thereof a charge transporting layer formed of a charge transporting material.

13. A method for displaying, comprising the steps of:

applying, to a displaying medium comprising plural pixel electrodes, a flat electrode and at least one cell therebetween containing at least two kinds of particles of different colors, one kind of particles of the at least two kinds of particles are particles comprising on a surface thereof a charge transporting layer having a hole transporting property, and the other kind of particles are particles comprising on a surface thereof a charge transporting layer having an electron transporting property, a voltage on the pixel electrode at a position corresponding to image data;

generating an electric field in a region of the displaying medium corresponding to the image data; and causing one kind of particles of the at least two kinds of particles to attach to the pixel electrode by the electric field to display an image.

14. A method for displaying an image as claimed in claim 13, wherein one kind of particles of the at least two kinds of particles are particles formed of a charge transporting material having a hole transporting property, and the other kind of particles are particles formed of a charge transporting material having an electron transporting property.

15. A method for displaying an image, comprising the steps of:

applying, to a displaying medium comprising plural pixel electrodes, a flat electrode and at least one cell therebetween containing at least two kinds of particles of different colors, some of the particles having a charge transporting property on the surface thereof and being formed of a charge transporting material, a voltage on the pixel electrode at a position corresponding to image data;

generating an electric field in a region of the displaying medium corresponding to the image data; and causing one kind of particles of the at least two kinds of particles to attach to the pixel electrode by the electric field to display an image.

16. An image displaying apparatus for displaying an image on a displaying medium, comprising:

the display medium comprising a first display substrate composed of plural pixel electrodes, a second display substrate composed of a flat electrode, and at least one cell therebetween containing at least two kinds of particles of different colors, one kind of particles of the at least two kinds of particles are conductive particles and some of the particles having a charge transporting property on at least a surface thereof; and voltage controlling means for applying a voltage to the pixel electrode corresponding to image data to generate an electric field and causing one kind of particles of the at least two kinds of particles to attach to a position of the pixel electrode corresponding to the image data.

17. An image displaying medium comprising:

a first display substrate composed of plural pixel electrodes;

a second display substrate composed of a flat electrode; and at least two kinds of particles of different colors contained in at least one cell provided between the first display substrate and the second display substrate, the particles having a charge transporting property on at least a surface thereof and one kind of particles of the at least two kinds of particles are conductive particles.

18. An image displaying medium as claimed in claim 17, wherein the conductive particles comprise a charge transporting layer formed of a charge transporting material on a surface thereof.

19. An image displaying medium as claimed in claim 17, wherein wiring for applying a voltage connected to each of the plural electrodes is formed on a transparent insulating layer formed on a surface of the pixel electrodes.

20. An image displaying medium, comprising:

a first display substrate composed of plural pixel electrodes;

a second display substrate composed of a flat electrode; and at least two kinds of particles of different colors contained in at least one cell provided between the first display substrate and the second display substrate, the particles having a charge transporting property on at least a surface thereof, wherein one kind of particles of the at least two kinds of particles comprise on a surface thereof a charge transporting layer having hole transporting property, and the other kind particles comprise on a surface thereof a charge transporting layer having an electron transporting property.

21. An image displaying medium, comprising:

a first display substrate composed of plural pixel electrodes;

a second display substrate composed of a flat electrode; and at least two kinds of particles of different colors contained in at least one cell provided between the first display substrate and the second display substrate, the particles having a charge transporting property on at least a surface thereof and comprising a charge transporting material.

22. An image displaying medium, comprising:

a first display substrate composed of plural pixel electrodes;

a second display substrate composed of a flat electrode; and at least two kinds of particles of different colors contained in at least one cell provided between the first display substrate and the second display substrate, the particles having a charge transporting property on at least a surface thereof, wherein one kind of particles of the at least two kinds of particles are particles comprising a charge transporting material having a hole transporting property, and the other kind particles are particles comprising a charge transporting material having an electron transporting property.

23. An image displaying medium, comprising:

a first charge transporting layer;

a second charge transporting layer;

first particles contained in at least one cell provided in a space between the first charge transporting layer and the second charge transporting layer; and second particles having a different color from the first particles and being movable by an electric field, wherein the displaying medium itself has no electrode, but the second particles are moved by application of an electric field from the outside of the displaying medium to display an image and wherein the second particles are conductive particles.

24. An image displaying medium as claimed in claim 23, wherein the cell is formed by a sheet member having a large number of openings.

25. An image displaying medium as claimed in claim 23, wherein the cell is formed by processing at least one of the first charge transporting layer and the second charge transporting layer.

26. An image displaying medium comprising:

a first conductive member;

a second conductive member;

first particles contained in at least one cell provided in a space between the first conductive member and the second conductive member; and second particles having a different color from the first particles and being contained in the space, the second particles having a charge transporting property on at least the surface thereof and being conductive particles.

27. An image displaying medium as claimed in claim 26, wherein the cell is formed by a sheet member having a large number of openings.

28. An image displaying medium as claimed in claim 26, wherein the cell is formed by processing at least one of the first conductive member and the second conductive member.

29. An image displaying medium comprising:

a first conductive member;

a second conductive member;

first particles contained in at least one cell provided in a space between the first conductive member and the second conductive member, the first particles having a charge transporting property on at least a surface thereof; and second particles having a different color from the first particles and being contained in the space, the second particles having a hole transporting property on at least a surface thereof.

30. An image displaying medium as claimed in claim 29, wherein the cell is formed by a sheet member having a large number of openings.

31. An image displaying medium as claimed in claim 29, wherein the cell is formed by processing at least one of the first conductive member and the second conductive member.

* * * * *